US005456072A

United States Patent [19]

Stern

[11] Patent Number: 5,456,072

[45] Date of Patent: Oct. 10, 1995

[54] SADDLE WITH GEL-CUSHION FOR PROVIDING COMFORT TO THE USER

[76] Inventor: Karen C. Stern, 7014 E. 5th St., Tucson, Ariz. 85710

[21] Appl. No.: 239,906

[22] Filed: May 9, 1994

[51] Int. Cl.[6] ..... B68C 1/02

[52] U.S. Cl. ..... 54/44.5; 54/44.7

[58] Field of Search ..... 54/44.5, 44.6, 54/44.7, 66; 297/214

[56] References Cited

U.S. PATENT DOCUMENTS 4,471,538 9/1984 Pomeranz et al. ..... 297/214 X
5,191,752 3/1993 Murphy ..... 54/44.5

FOREIGN PATENT DOCUMENTS 19335 of 1900 United Kingdom ..... 54/66

*Primary Examiner*—Robert P. Swiatek

[57] ABSTRACT

A saddle with gel-cushion for providing comfort to the user comprising a saddle tree formed of a rigid material having an upwardly extending front edge, a rearwardly extending back edge and sides; a flexible sheet material covering the tree on the lower surface of the tree and the upper surface of the tree and coupled around the periphery thereof to encompass the tree; a pocket formed beneath the sheet material and the tree; a pocket formed beneath the sheet material above the tree and between the material of the flaps; a bladder formed of a liquid impervious material having an exterior sheet and interior sheet and secured around the periphery thereof located within the pocket; a plurality of horizontally disposed channels formed in the bladder by lines of connection coupling the exterior and interior sheets of the bladder along spaced horizontal lines; and a quantity of gel material located in each of the channels adapted to deform under pressure created by the person riding on the saddle for increased comfort.

2 Claims, 4 Drawing Sheets

PRIOR ART

SADDLE WITH GEL-CUSHION FOR PROVIDING COMFORT TO THE USER

BACKGROUND OF THE INVENTION

1. Field of the Invention

The present invention relates to a new and improved saddle with gel-cushion for providing comfort to the user and, more particularly, pertains to making more comfortable the ride of a horseperson in a saddle.

2. Description of the Prior Art

The use of saddles of various sizes, shapes and constructions is known in the prior art. More specifically, saddles of various sizes, shapes and constructions heretofore devised and utilized for the purpose of shaping saddles of various materials for increased utility and comfort are known to consist basically of familiar, expected, and obvious structural configurations, notwithstanding the myriad of designs encompassed by the crowded prior art which has been developed for the fulfillment of countless objectives and requirements.

The prior art discloses a large number of saddles of various sizes, shapes and constructions. By way of example, U.S. Pat. No. 3,672,123 discloses trotting horse saddles.

U.S. Pat. No. 4,765,126 discloses a saddle.

U.S. Pat. No. 5,119,618 discloses a saddle-fault correcting saddle pad.

U.S. Pat. No. 5,121,962 discloses a cushion for absorbing shock damping vibration and distributing pressure.

Lastly, U.S. Pat. No. Des. 329,308 discloses the design of a gel-filled saddle pad.

In this respect, the saddle with gel cushion for providing comfort to the user according to the present invention substantially departs from the conventional concepts and designs of the prior art, and in doing so provides an apparatus primarily developed for the purpose of making more comfortable the ride of a horseperson in a saddle.

Therefore, it can be appreciated that there exists a continuing need for a new and improved saddle with gel-cushion for providing comfort to the user which can be used for making more comfortable the ride of a horseperson in a saddle. In this regard, the present invention substantially fulfills this need.

SUMMARY OF THE INVENTION

In view of the foregoing disadvantages inherent in the known types of saddles of various sizes, shapes and constructions now present in the prior art, the present invention provides a new and improved saddle with gel-cushion for providing comfort to the user. As such, the general purpose of the present invention, which will be described subsequently in greater detail, is to provide a new and improved saddle with gel-cushion for providing comfort to the user and methods which have all the advantages of the prior art and none of the disadvantages.

To attain this, the present invention essentially comprises a new and improved saddle with gel-cushion for providing comfort to the user comprising, in combination, a saddle tree formed of a rigid material having an upwardly extending front edge, a rearwardly extending back edge and sides; a flexible leather covering the tree on the lower surface of the tree and the upper surface of the tree and coupled around the periphery thereof to encompass the tree; a flap extending downwardly from each side of the saddle, the flaps being fabricated of leather as an extension of the leather covering the tree; a pocket formed beneath the leather above the tree and between the material of the flaps; a bladder formed of a liquid impervious material having an exterior sheet and interior sheet and secured around the periphery thereof located within the pocket; a plurality of horizontally disposed channels formed in the bladder by lines of connection coupling the exterior and interior sheets of the bladder along spaced horizontal lines; and a quantity of gel material located in each of the channels adapted to deform under pressure created by the person riding on the saddle for increased comfort.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved saddle with gel-cushion for providing comfort to the user which has all the advantages of the prior art saddles of various sizes, shapes and constructions and none of the disadvantages.

It is another object of the present invention to provide a new and improved saddle with gel-cushion for providing comfort to the user which may be easily and efficiently manufactured and marketed.

It is a further object of the present invention to provide a new and improved saddle with gel-cushion for providing comfort to the user which is of a durable and reliable construction.

An even further object of the present invention is to provide a new and improved saddle with gel-cushion for providing comfort to the user which is susceptible of a low cost of manufacture with regard to both materials and labor, and which accordingly is then susceptible of low prices of sale to the consuming public, thereby making such saddle with gel-cushion for providing comfort to the user economically available to the buying public.

Still yet another object of the present invention is to provide a new and improved saddle with gel-cushion for providing comfort to the user which provides in the apparatuses and methods of the prior art saddles some of the advantages thereof, while simultaneously overcoming some of the disadvantages normally associated therewith.

Even still another object of the present invention is to make more comfortable the ride of a horseperson in a saddle.

Lastly, it is an object of the present invention to provide a saddle with gel-cushion for providing comfort to the user comprising a saddle tree formed of a rigid material having an upwardly extending front edge, a rearwardly extending back edge and sides; a flexible sheet material covering the tree on the lower surface of the tree and the upper surface of the tree and coupled around the periphery thereof to encompass the tree; a pocket formed beneath the sheet material and the tree; a pocket formed beneath the sheet material above the tree and between the material of the flaps; a bladder formed of a liquid impervious material having an exterior sheet and interior sheet and secured around the periphery thereof located within the pocket; a plurality of horizontally disposed channels formed in the bladder by lines of connection coupling the exterior and interior sheets of the bladder along spaced horizontal lines; and a quantity of gel material located in each of the channels adapted to deform under pressure created by the person riding on the saddle for increased comfort.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
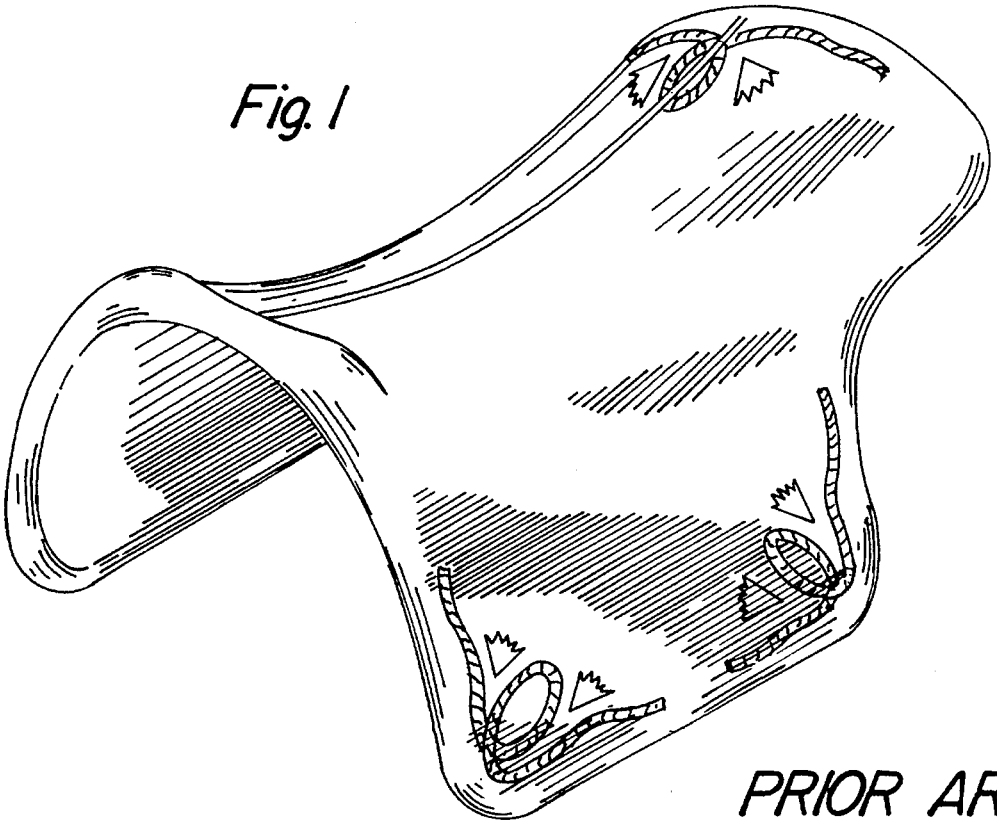
FIG. 1 is a perspective illustration of a prior art saddle.
Figure 2:
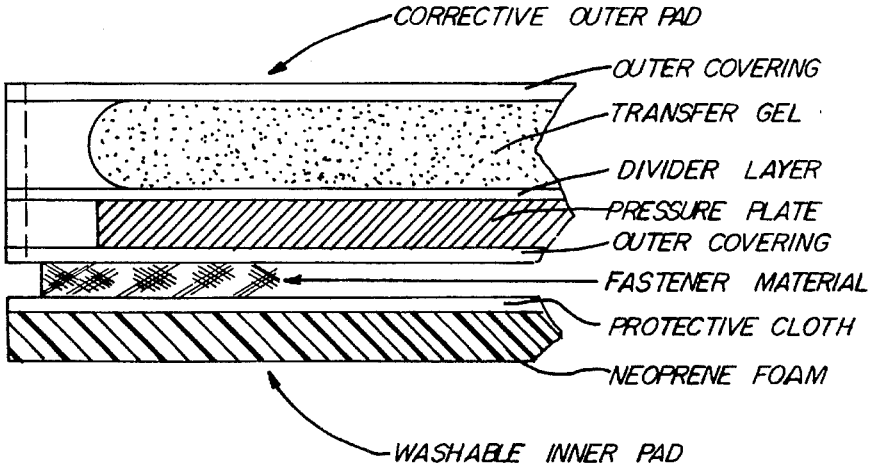
PRIOR ART Fig. 2
FIG. 2 is a cross sectional view of a prior art saddle.
Figure 3:
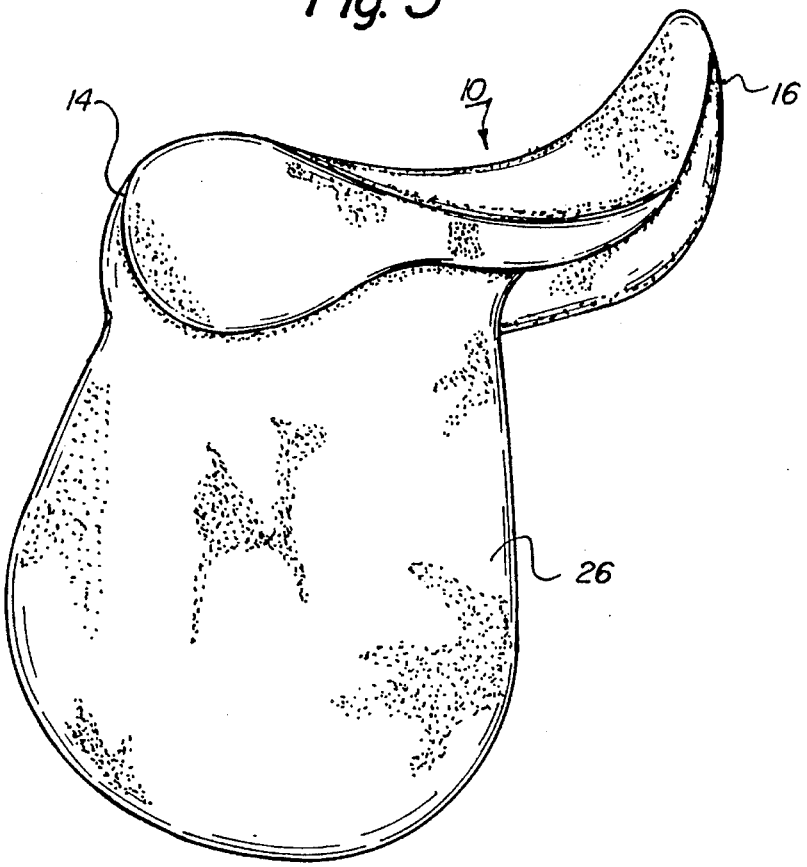
FIG. 3 is a side elevational view of the preferred embodiment of the new and improved saddle with gel-cushion for providing comfort to the user constructed in accordance with the principles of the present invention.
Figure 4:
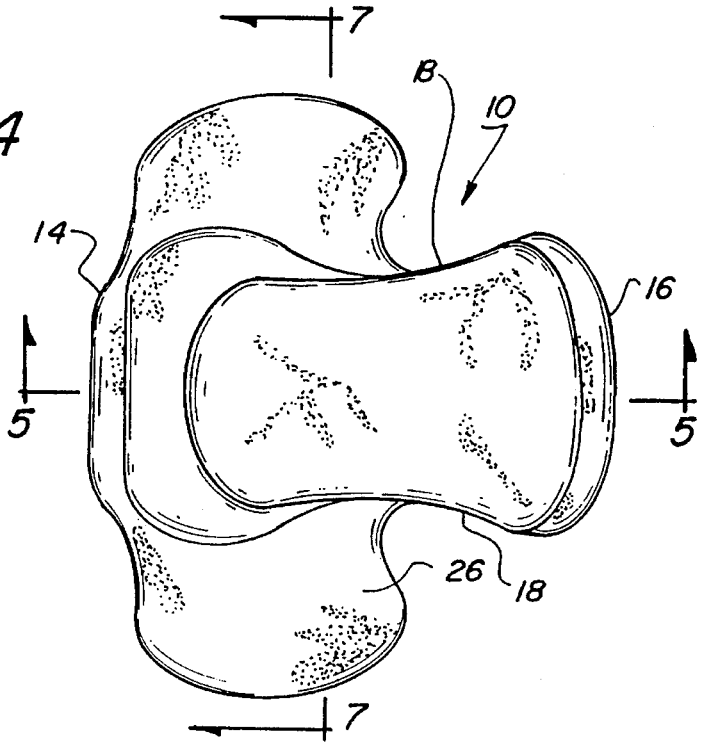
FIG. 4 is a top elevational view of the saddle illustrated in FIG. 3.
Figure 5:
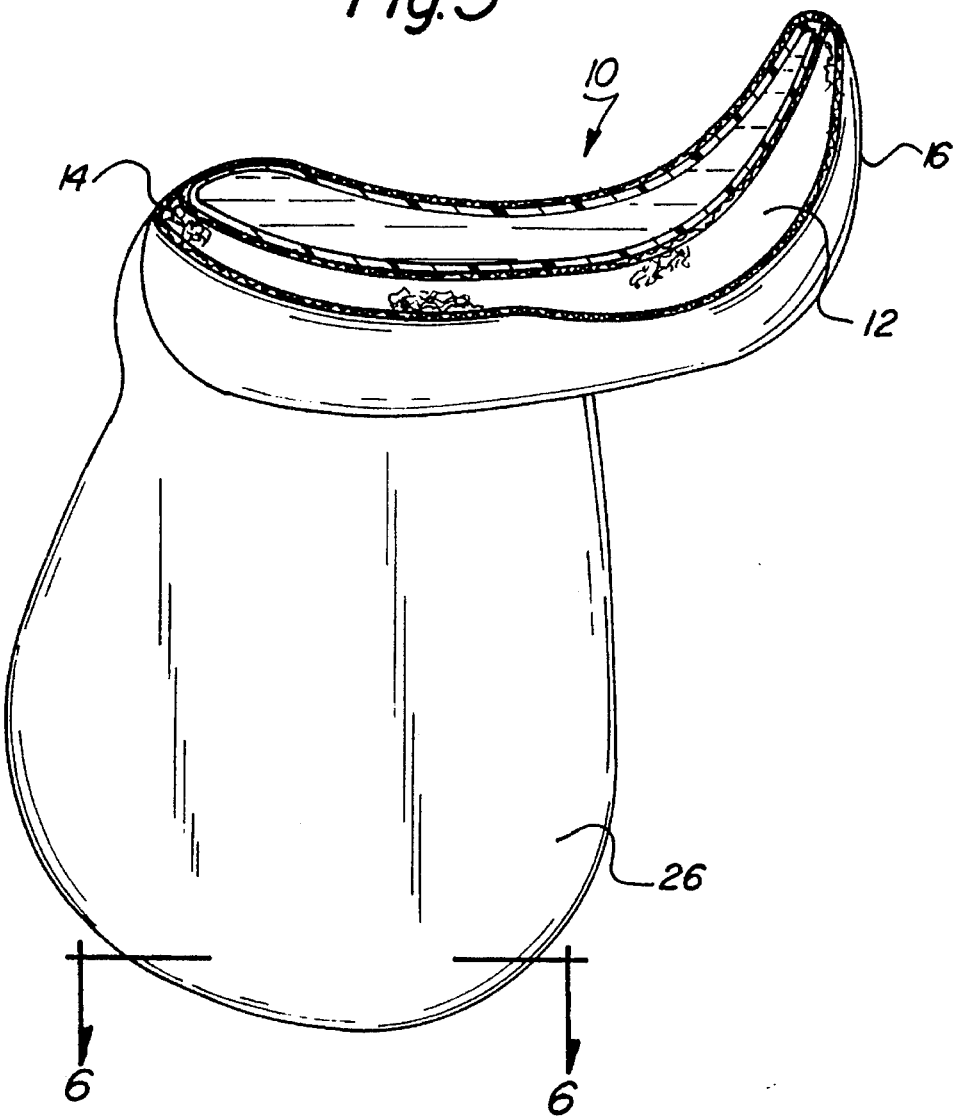
FIG. 5 is a cross-sectional view of the saddle shown in FIGS. 3 and 4 taken along lines 5—5 of FIG. 4.
Figure 6:
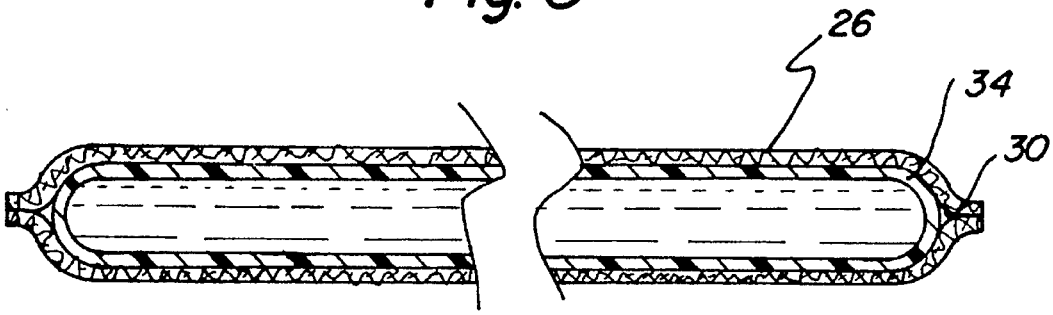
FIG. 6 is a cross-sectional view of the saddle shown in FIG. 5 taken along lines 6—6 of FIG. 5.
Figure 7:
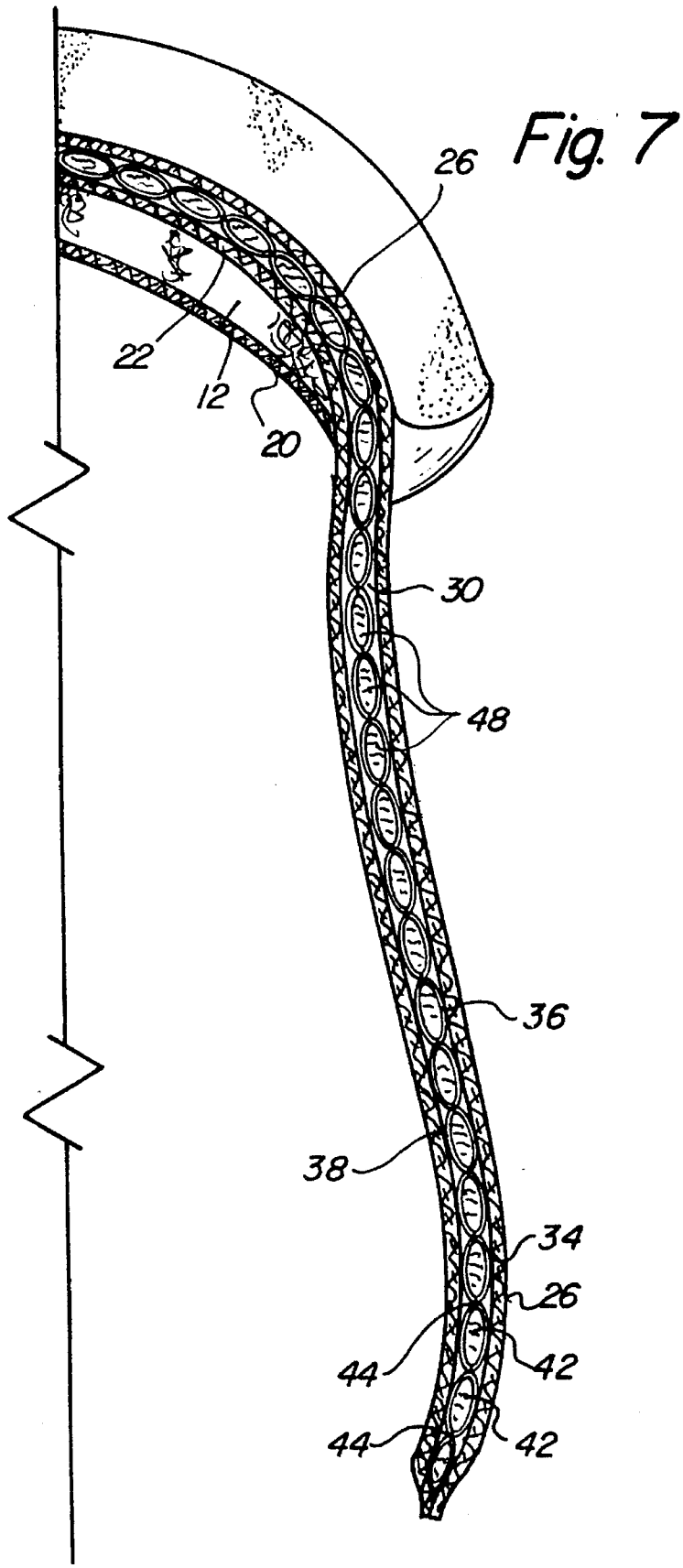
FIG. 7 is a cross sectional view taken along one-half of line 7—7 of FIG. 4.

With reference now to the drawings, and in particular to FIG. 3 thereof, the preferred embodiment of the new and improved saddle with gel-cushion for providing comfort to the user embodying the principles and concepts of the present invention and generally designated by the reference numeral 10 will be described.

The present invention, the new and improved saddle with gel-cushion for providing comfort to the user is comprised of a plurality of components elements. Such component elements are configured to attain the desired objective. Such component elements include, in their broadest context, a tree, sheet material, flaps, a bladder, channels and gel.

More specifically, the saddle 10 of the present invention is built about a saddle tree 12. The saddle tree is generally conventional. It is formed of a rigid material and provides an upwardly extending front edge 14, a rearwardly extending back edge 16 and side edges 18. The rigid material of the saddle tree is traditionally wood, but it may be plastic or other rigid material of a lightweight construction.

Next provided is a flexible sheet material 20 and 22 adapted to cover the tree on the lower surface of the tree and the upper surface of the tree. Such material is coupled around the periphery as by stitching to encompass the tree. The sheet material is preferably leather for fine saddles but may be of a durable plastic.

Next provided are a pair of flaps 26. The flaps extend downwardly from each side of the upper portion of the saddle. The flaps are fabricated of a flexible material, preferably the same as that over the tree, and formed as a continuing extension of such material.

Next provided is a pocket 30. The pocket is formed beneath the sheet material above the tree and between the material layers forming the flaps. The pocket is simply a space for the purpose to be later discussed.

Next provided is a bladder 34. The bladder is fabricated of a liquid-impervious material. It is formed of an exterior sheet 36 and an interior sheet 38. It is secured around the periphery thereof as by heat-sealing to make a fluid tight relationship between the sheets. The bladder is of a size and configuration to fit within the pocket.

Formed within the bladder are a plurality of channels 42. Such channels are horizontally disposed. They are formed in the bladder by heat-sealed lines 44 forming lines of connection. Such lines of connection are for coupling the exterior and interior sheets of the bladder upon spaced horizontal lines.

The last component of the saddle is a quantity of gel material 48. Such material is located in each of the channels. The gel material is a viscous liquid. It is adapted to deform and reposition itself under pressure as might be created by the legs of a person riding on the saddle. The purpose is for the increased comfort of such person riding on the saddle.

The use of the horizontally disposed channels of a relatively small size as compared to the space of the pocket between the exterior and interior layers of the saddle is so that deforming gel material will be maintained at a proper elevational location during use of the saddle. Without such horizontal channels, the gel would tend to fall downwardly. As a result, no gel would be left in the upper extent of the saddle.

The present invention incorporates a layer of entrapped gelatin upon which the rider sits. It is similar in construction to a conventional saddle except the seating and side panel areas are formed in two layers which create a contoured, sealed internal pocket spanning these two areas. It is in this pocket that the gelatin is contained. The rider will actually be seated on a "pool" of viscous liquid material which will effectively absorb the shock and pounding that is normally experienced by a rider. It will ebb and flow to suit both the movement of the horse and the contours of the rider's body.

From the foregoing description, it can be seen that the present invention is extremely comfortable. However, there is another consideration which may be even more important—namely, the avoidance of injury. The movements and gait of a horse are sometimes unpredictable, and even experienced and seasoned riders may be surprised and unable to compensate in time. The novice will almost invariably be subjected to unexpected impact. Injuries from this type of situation are commonplace. The present invention addresses and provides a means to protect against these problems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved saddle with gel-cushion for providing comfort to the user comprising, in combination:

a saddle tree formed of a rigid material having an upwardly extending front edge, a rearwardly extending back edge and sides;

a flexible leather covering the tree on the lower surface of the tree and the upper surface of the tree and coupled around the periphery thereof to encompass the tree;

a flap extending downwardly from each side of the saddle, the flaps being fabricated of leather as an extension of the leather covering the tree;

a pocket formed beneath the leather above the tree and between the material of the flaps;

a bladder formed of a liquid impervious material having an exterior sheet and interior sheet and secured around the periphery thereof located within the pocket;

a plurality of horizontally disposed channels formed in the bladder by lines of connection coupling the exterior and interior sheets of the bladder along spaced horizontal lines; and a quantity of gel material located in each of the channels adapted to deform under pressure created by the person riding on the saddle for increased comfort.

2. A saddle with gel-cushion for providing comfort to the user comprising:

a saddle tree formed of a rigid material having an upwardly extending front edge, a rearwardly extending back edge and sides;

a flexible sheet material covering the tree on the lower surface of the tree and the upper surface of the tree and coupled around the periphery thereof to encompass the tree;

a downwardly extending flap on each side of the tree formed as an extension of the sheet material covering the upper surface of the tree;

a pocket formed within the sheet material above the tree and between the material of the flaps;

a bladder formed of a liquid impervious material having an exterior sheet and interior sheet and secured around the periphery thereof located within the pocket;

a plurality of horizontally disposed channels formed in the bladder by lines of connection coupling the exterior and interior sheets of the bladder along spaced horizontal lines; and a quantity of gel material located in each of the channels adapted to deform under pressure created by the person riding on the saddle for increased comfort.

* * * * *